US010610728B2

(12) United States Patent
Fano et al.

(10) Patent No.: US 10,610,728 B2
(45) Date of Patent: Apr. 7, 2020

(54) DEVICES AND METHODS FOR TARGETED ISOLATION AND EXERCISING OF THE GLUTEAL MUSCLES

(71) Applicant: BOOTY MAKER, LLC, Boca Raton, FL (US)

(72) Inventors: Darren A. Fano, Boca Raton, FL (US); Christopher Bohn, Boca Raton, FL (US)

(73) Assignee: BOOTYMAKER, LLC, Boca Raton, FL (US)

( * ) Notice: Subject to any disclaimer, the term of this patent is extended or adjusted under 35 U.S.C. 154(b) by 0 days.

(21) Appl. No.: 15/849,769

(22) Filed: Dec. 21, 2017

(65) Prior Publication Data

US 2018/0178058 A1 Jun. 28, 2018

Related U.S. Application Data

(60) Provisional application No. 62/439,184, filed on Dec. 27, 2016.

(51) Int. Cl.

| | |
|---|---|
| ***A63B 23/04*** | (2006.01) |
| ***A63B 21/04*** | (2006.01) |
| ***A63B 21/055*** | (2006.01) |
| ***A63B 21/00*** | (2006.01) |
| ***A63B 23/035*** | (2006.01) |

(Continued)

(52) U.S. Cl.

CPC .... *A63B 23/0405* (2013.01); *A63B 21/00061* (2013.01); *A63B 21/00065* (2013.01); *A63B 21/0414* (2013.01); *A63B 21/0442* (2013.01); *A63B 21/0557* (2013.01); *A63B 21/4023* (2015.10); *A63B 21/4035* (2015.10); *A63B 21/4037* (2015.10); *A63B 23/0222* (2013.01); *A63B 23/0355* (2013.01); *A63B 23/1209* (2013.01); *A63B 21/0726* (2013.01); *A63B 2208/0252* (2013.01)

(58) Field of Classification Search

CPC ..... A63B 21/02–0557; A63B 21/0414; A63B 6/00; A63B 21/4037; A63B 23/02–0244; A63B 23/0405; A63B 21/0557; A63B 21/00061; A63B 21/00065; A63B 23/0355; A63B 21/4023; A63B 21/4035; A63B 23/0222; A63B 21/0442; A63B 23/1209; A63B 21/0726; A63B 2208/0252; A63B 21/0552

See application file for complete search history.

(56) References Cited

U.S. PATENT DOCUMENTS 1,604,118 A * 10/1926 Glancey ..... A63B 21/1681 33/262
3,967,333 A * 7/1976 Boyd ..... A47D 11/00 5/424

(Continued)

*Primary Examiner* — Nyca T Nguyen
(74) *Attorney, Agent, or Firm* — Keith G. Haddaway; Venable LLP; Elizabeth Gitlin

(57) ABSTRACT

Devices and methods for targeting and isolating specific regions of the gluteus muscle groups use a resistive band extending over an exerciser's pelvis region while performing gluteus bridge exercises. By adjusting the position of his or her body on the exercise board, an exerciser may precisely target and tone specific regions of the gluteus muscle group. Additional anchor points and cables may be used to perform many additional exercises with the exercise system.

16 Claims, 16 Drawing Sheets

(51) Int. Cl.

| | |
|---|---|
| ***A63B 23/02*** | (2006.01) |
| ***A63B 23/12*** | (2006.01) |
| *A63B 21/072* | (2006.01) |

(56) References Cited

U.S. PATENT DOCUMENTS

| | | | | |
|---|---|---|---|---|
| 4,198,044 | A * | 4/1980 | Holappa | A63B 21/04 482/130 |
| 4,606,539 | A * | 8/1986 | Farnham | A63B 21/0023 482/148 |
| 4,706,953 | A * | 11/1987 | Graham | A63B 21/0622 482/110 |
| 4,775,150 | A * | 10/1988 | Graham | A61H 1/0218 128/876 |
| 4,863,163 | A * | 9/1989 | Wehrell | A63B 5/16 482/123 |
| 4,968,028 | A * | 11/1990 | Wehrell | A63B 5/16 482/124 |
| 5,336,138 | A * | 8/1994 | Arjawat | A63B 23/025 482/10 |
| 5,954,622 | A | 9/1999 | Olschansky et al. | |
| 6,220,994 | B1 * | 4/2001 | Rich | A63B 21/0004 482/123 |
| 6,450,926 | B1 * | 9/2002 | McKernan | A63B 21/0004 482/148 |
| 6,634,998 | B2 * | 10/2003 | Siaperas | A63B 21/04 482/123 |
| 6,757,944 | B2 | 7/2004 | Buscart | |
| 7,494,453 | B2 * | 2/2009 | Wehrell | A63B 21/055 482/124 |
| 8,096,923 | B2 * | 1/2012 | White | A63B 21/4037 482/148 |
| 8,403,818 | B1 * | 3/2013 | Wilkinson | A63B 21/00069 482/121 |
| 8,562,494 | B2 * | 10/2013 | Thomas | A63B 21/0555 482/121 |
| 8,715,144 | B1 * | 5/2014 | Friess | A63B 21/4035 482/123 |
| 8,721,507 | B2 * | 5/2014 | Blancher | A63B 21/4033 482/121 |
| 9,737,748 | B1 * | 8/2017 | Chapman | A63B 21/0442 |
| 9,901,502 | B2 * | 2/2018 | Rosario, Jr. | A61G 13/009 |
| 10,149,995 | B1 * | 12/2018 | Ashe | A41D 19/0037 |
| 10,286,244 | B2 * | 5/2019 | Reese | A63B 5/16 |
| 2002/0132711 | A1 * | 9/2002 | Wallerstein | A63B 23/0211 482/140 |
| 2002/0160891 | A1 * | 10/2002 | Gallagher | A63B 21/04 482/123 |
| 2002/0173411 | A1 * | 11/2002 | Wallerstein | A63B 23/0211 482/92 |
| 2006/0100070 | A1 | 5/2006 | Abdo | |
| 2008/0119338 | A1 * | 5/2008 | Prsala | A63B 21/0552 482/142 |
| 2010/0197471 | A1 * | 8/2010 | Hayes | A63B 6/00 482/140 |
| 2013/0244835 | A1 * | 9/2013 | Thompson | A63B 21/062 482/8 |
| 2014/0113780 | A1 | 4/2014 | Emmert | |
| 2016/0144217 | A1 * | 5/2016 | Oltorik, Jr. | A63B 21/0442 482/130 |
| 2016/0296785 | A1 | 10/2016 | Kamins | |
| 2017/0100638 | A1 * | 4/2017 | Breibart | A63B 69/0057 |
| 2017/0239124 | A1 * | 8/2017 | Cunningham | A63B 21/00054 |
| 2017/0333744 | A1 * | 11/2017 | Chapman | A61H 1/024 |
| 2017/0368400 | A1 * | 12/2017 | Chapman | A63B 21/0555 |
| 2018/0117396 | A1 * | 5/2018 | Engelfried, Jr. | A63B 23/0355 |
| 2018/0133541 | A1 * | 5/2018 | Cooper | A63B 21/4037 |
| 2018/0207470 | A1 * | 7/2018 | Duffy | A63B 21/0552 |
| 2018/0290002 | A1 * | 10/2018 | Colangelo | A63B 21/00043 |
| 2019/0111302 | A1 * | 4/2019 | Ballestero | A63B 21/0414 |

* cited by examiner

DEVICES AND METHODS FOR TARGETED ISOLATION AND EXERCISING OF THE GLUTEAL MUSCLES

CROSS-REFERENCE TO RELATED APPLICATIONS

This application claims priority to U.S. Provisional Application Ser. No. 62/439,184 filed on Dec. 27, 2016, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to devices and methods for exercising. More particularly, the invention relates to devices and methods for exercising the gluteal muscles and specific regions of the gluteal muscles.

Description of the Related Art

The gluteal muscles, the muscle group located at the buttocks, is one of the largest muscle groups on the human body and is comprised of several different muscles originating from the ilium and sacrum bones of the pelvis and inserted on the femur. They are responsible for a wide range of complex motions at the hip joint including extension, abduction, external rotation and internal rotation. They are vital components of core strength, good posture and for preventing undue stress and flexion of the spine and individual bones of the pelvis. It is therefore important to maintain tone, strength and flexibility of all of the individual muscles in the gluteal muscle group. The gluteal muscles are also important for aesthetic purposes. Healthy gluteal muscles are not only beneficial for a person's health, but are as that a clean pleasing. Good muscle tone also improves distribution of adipose tissues, i.e. the panniculus adiposus, surrounding the gluteal muscle group.

Because of the importance of the gluteal muscle group to both physical health as well as appearance, there is great interest in methods and devices for exercising and toning this region of the body. However, although the gluteal muscle group is large and used during the most common bodily movements, it is relatively difficult to isolate individual muscles within the gluteal group. Despite there being a broad nimiety of exercise techniques, machines, devices as well as sundry gadgets intended to improve tone and shape of gluteal muscles, most machines and techniques target the gluteal muscle group as a whole or alternatively target a particular type of motion, such as extension or abduction. As a result, the devices and methods for exercising the gluteal muscles have not allowed operators to adequately and precisely target specific regions and individual muscles within specific regions of the gluteal muscles in order to maximize results and focus on regions of the muscle group requiring extra attention.

Current exercise systems and methods are encumbered by a number of drawbacks. Some place stress and forces on a user that can cause damage, for example, to a user's spine. In addition, current exercise systems fail to provide for isolation of specific muscle groups, such as gluteal muscles, during one or more exercises.

FIGS. 1-4 illustrate a common exercise known in the prior art as a "gluteal bridge" or more simply as a "glute bridge." FIG. 1 shows an exerciser 10 in a supine position on an exercise mat 12. This is referred to as the rest position. Her knees 74 and hip joint 16 are both bent such that the exerciser's gluteal muscles 18 and her feet 20 are both on the mat 12. FIG. 2 shows the exerciser 10 in the up position, where her hip joints 16 have been flexed such that her thighs 22 are parallel to her torso 24, and her feet 20 remain on the mat 12. Translating from the rest position to the up position requires an exerciser 10 to contract substantially all of the muscles and muscle regions that make up the gluteal muscles 18. There are a wide variety of minor modifications that have been developed for the glute bridge exercise. For example, in FIGS. 1 and 2, the exerciser 10 has extended her arms 26 in an outward, lateral direction away from her body. Optionally, an exerciser may position his or her arms alongside the body. An exerciser's arms 26 may alternatively be placed across his or her chest, extending upward above the head or underneath the exerciser. In some variations of a glute bridge, an exerciser may incorporate arm movements and/or exercises to provide a more intense workout.

FIGS. 3 and 4 show one such modification to the glute bridge exercise. Here, an exerciser 28 again lies in a supine position, in this example without a mat. When in the rest position shown in FIG. 3, the exerciser's 28 gluteal muscles 30 and feet 32 both rest upon the ground and her knees 34 and hip joints 36 are bent. The exerciser 28 has modified the glute bridge exercise by holding a free weight 38 in a position over her pelvis and lower torso. As the exerciser 28 translates to the up position shown in FIG. 4, her gluteal muscles 30 contract such that her thighs 40 become parallel to her torso 42. The placement of the weight 38 about her hip joints 36 increases the amount of work that must be done by her gluteal muscles 30, thereby providing a more intense workout. Because the exerciser's 28 hands and arms are engaged in positioning and securing the free weight 38, they are unable to perform any other actions during the exercise. In addition, free weights are typically not designs to engage with a pelvis or torso. The free weight 38 is therefore not secure to this location and carelessness or distraction can lead to injury.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide devices and methods for exercising, toning and actuating gluteal muscles and muscles ancillary to the gluteal muscles. It is also desirable to provide devices and methods for specifically targeting and focusing exercise on specific regions of gluteal muscles and muscles ancillary to them.

BRIEF SUMMARY OF THE INVENTION

Disclosed is an exercise system comprising an exercise board extending longitudinally from a first end to a second end, a first pair of fasteners coupled to the exercise board, and an elastic band adapted to be adjustably coupled to the first pair of fasteners. Each fastener of the first pair of fasteners positioned proximate a perimeter of the exercise board such that the band will contact a user at a position just inferior to the anterior superior iliac spine when a user lies on the exercise board. The exercise system may include at least one cable retention device coupled to the exercise board, wherein the cable retention device is configured to couple an elastic cable to the exercise board. Optionally, the first pair of fasteners may comprise a first clamp and a second clamp. Each clamp of the pair of clamps may be mounted to the exercise board 4 proximate opposite side edges of the exercise board at a position 20% to 49% of a length of the exercise board. The exercise system may further comprise a at least a second pair of fasteners coupled proximate a perimeter of the exercise board, said second pair of fasteners adapted for coupling to a second elastic band for performing a leg exercise. The exercise system may further comprise a belt adapted to removably couple to at least two elastic bands wherein an opposite end of each of the at least two elastic bands is adapted to removably couple to the second pair of fasteners for performing a leg exercise without inducing additional stress on the user's back.

In another embodiment, an exercise mat comprises a planar, rigid body having a length. A first track extends along a portion of the length of the body and having a first carriage slidingly engaged with the first track. A resistive band comprised of an elastic material and attached to the first carriage. The exercise mat may have the first track located along a first side of the body, and may include a second track extending along a second side of the body coextensive with and opposing to the first track and having a second carriage slidingly engaged with the second track. The resistive band may be attached to the first carriage at a first and, and is attached to the second carriage at a second end. The resistive band may include a plurality of interchangeable bands having different degrees of elasticity.

The body may have a foot region, a head region and a shoulder region and further comprises a padded headrest on the head region. The exercise mat may include a foot region configured and sized to accommodate two feet of a person exercising on the mat and having a textured surface. A shoulder region may be configured and sized to accommodate shoulders of a person exercising on the mat and having a textured surface.

In another embodiment, a method for performing a gluteus bridge exercise comprises providing an exercise mat having a planar, rigid body having a foot region, a shoulder region, a length and two sides, the two sides having opposing coextensive tracks extending a portion of the length of the body. Each of the tracks has a slidingly engaged carriage. The two carriages serve as anchor points for an elastic resistive band extending between them. The exerciser is positioned in a supine position on top of the mat with the exerciser's shoulders positioned within the shoulder region and the exerciser's feet positioned within the foot region and the elastic resistive band extending over the exerciser's pelvic region. The exerciser translates between a rest position and an up position. In the rest position, the exerciser's gluteus muscles rest on the body of the mat between the shoulder region and the foot region and the exerciser's thighs and torso form an obtuse angle. In the up position, the exerciser's gluteus muscles are positioned above the exercise mat and the exerciser's thighs and torso are parallel.

Specific regions of the exerciser's gluteus muscles may be specifically targeted by aligning the resistive band along a plane that intersects the targeted region of the gluteus muscles.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
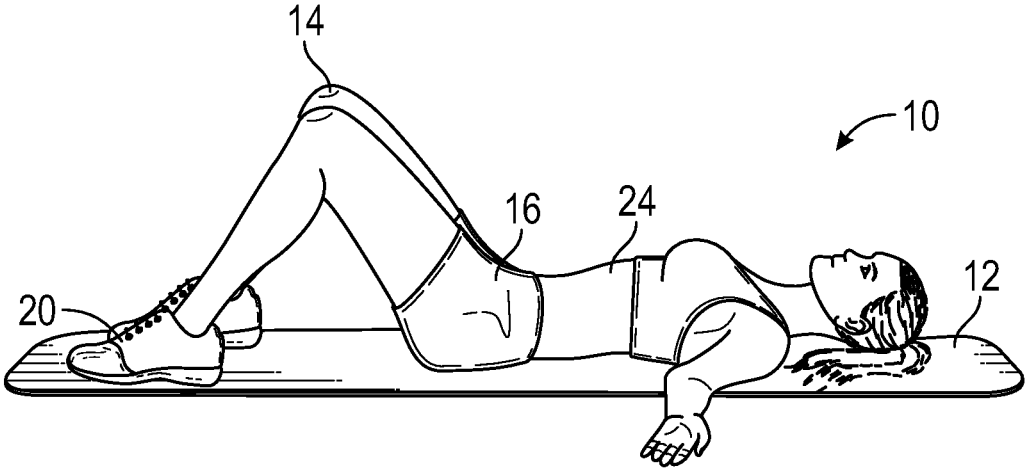
FIG. 1 (Prior Art)
FIG. 1 is a perspective view of a rest position of a gluteus bridge exercise of the prior art.
Figure 2:
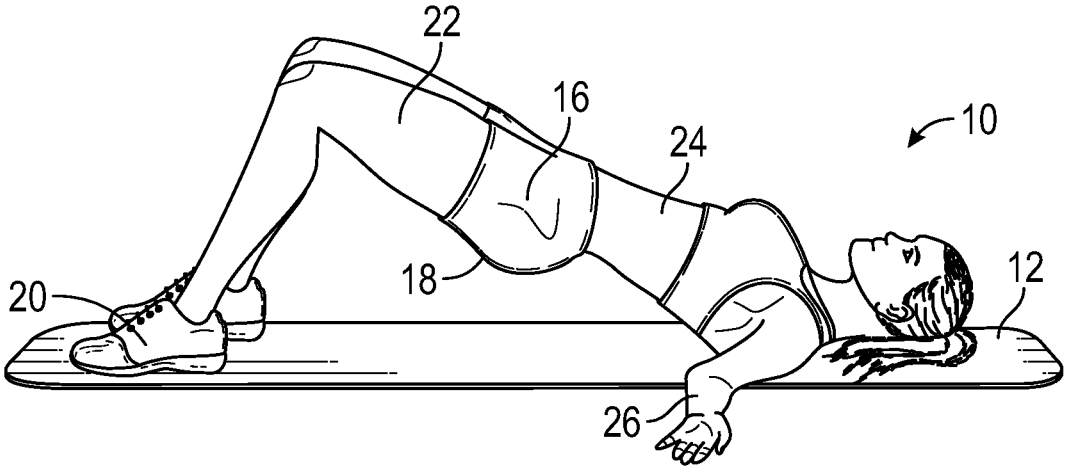
FIG. 2 (Prior Art)
FIG. 2 is a perspective view of an up position of a gluteus bridge exercise of the prior art.
Figure 3:
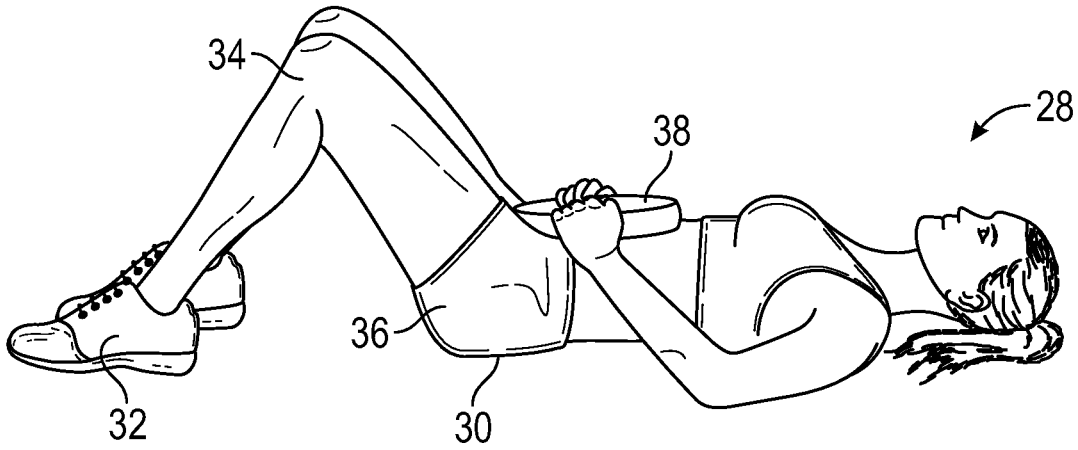
FIG. 3 (Prior Art)
FIG. 3 is a perspective view of a rest position of a gluteus bridge exercise incorporating a free weight of the prior art.
Figure 4:
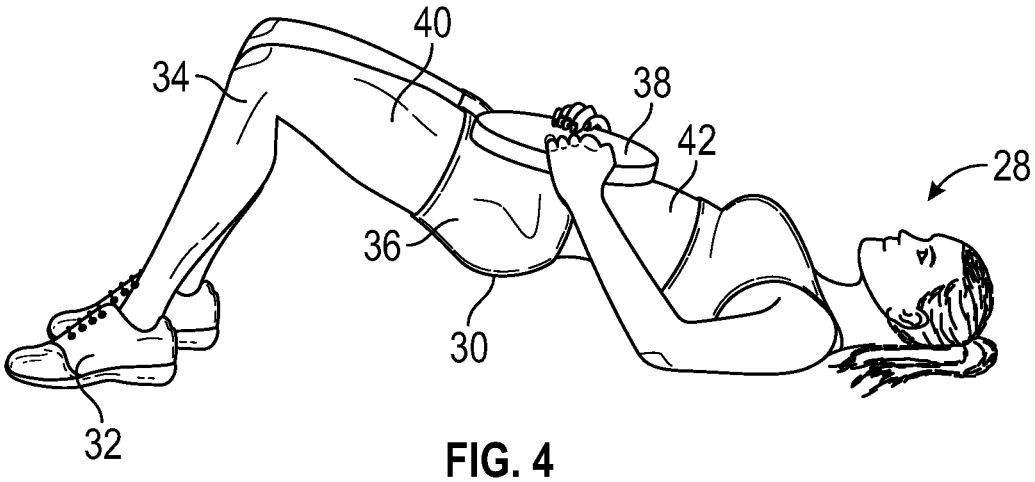
FIG. 4 (Prior Art)
FIG. 4 is a perspective view of an up position of a gluteus bridge exercise incorporating a free weight of the prior art.
Figure 5:
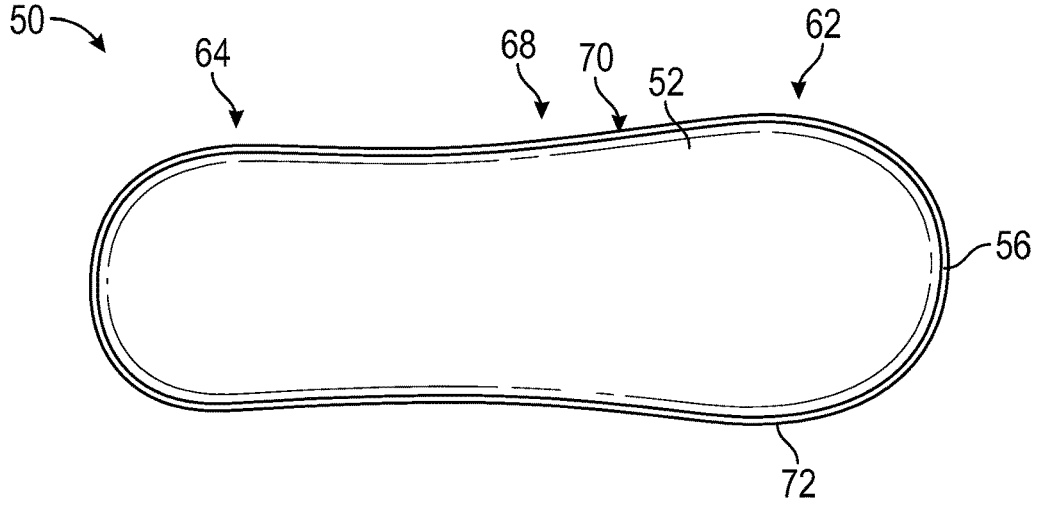
FIG. 5 is a top plan view of an exercise board in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In drawing figures are not necessarily to scale and certain features of the invention may be shown exaggerated and scale on somewhat schematic form in the interest of clarity and conciseness. Relative terms such as "horizontal" "vertical," "up," "down," "top," "bottom," as well as derivatives thereof (e.g. "horizontally," "downwardly," "upwardly," etc.) Should be construed to refer to the orientation as then described or as shown in the drawing figure under discussion. These relative terms are for convenience of description and normally are not intended to require a particular orientation. Terms including "downwardly" versus "outwardly," "longitudinal" versus "lateral" and the like are to be interpreted relative to one another or relative to an access of elongation, and access or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise, and include terms such as "directly" coupled, secured, etc. the term "operatively coupled" is such an attachment, coupling, where connection that allows the pertinent structure to operate as intended by virtue of that relationship.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

In various embodiments, an exercise system is disclosed. The exercise system includes an exercise board and an elastic band coupled thereto. The exercise board extends from a first end to a second end generally along a longitudinal axis. In some embodiments, the exercise board includes a curved outer edge defining one or more radii of curvature, although it will be appreciated that other shapes are possible and are within the scope of this disclosure. The elastic band can be adjustably coupled to the exercise board. The elastic band can be coupled to the exercise board by one or more clamps and/or other fixation devices. The band is configured to transfer a resistive force to a user at a predetermined angle during one or more exercises. In some embodiments the elastic band is adjustably coupled to the exercise board such that the elastic band interfaces with a user at a predetermined position on the user. As used herein, "band" includes elongated members with a variety of cross-sections including circular, circular if a hollow center (i.e. tubular), rectangular, etc.

FIGS. 5-11 illustrate various elements of an exercise system 50 in accordance with some embodiments of the principles of the invention. The exercise system 50 includes an exercise board 52. The exercise board 52 extends generally along a longitudinal axis 54 from a first end 56 to a second end 58. In some embodiments the exercise board 50 has a curved outer edge 60 defining one or more radii of curvature. For example, in the illustrated embodiment, the outer edge 60 defines a first convex area 62 at the first end 56, a second convex area 64 at the second end 58, and a concave area 68 between the first convex area 62 and the second convex area 64. In the illustrated embodiment, a first side 70 of the exercise board 52 and a second side 72 have similar curve patterns, although it will be appreciated that the first side 70 and the second side 72 can have different curve patterns.

In some embodiments, and elastic band 74 can be adjustably coupled to exercise board 52. The elastic band 74 can be coupled to any suitable portion of the exercise board 52. For example, in some embodiments, the elastic band 74 is coupled to adjustable fasteners (e.g. clamps 76 & 78) mounted to the exercise board 52 between a midpoint and the first end 56. In some embodiments, the elastic band 74 is coupled to an adjustable fastener (e.g. clamps 76 & 78) mounted to the exercise board 52 in a middle longitudinal third of the exercise board 52 or middle longitudinal fifth of the exercise board 52. In some embodiments, the elastic band 74 is coupled to an adjustable fastener (e.g. clamps 76 & 78) mounted to the exercise board 52 at a position 20% to 49% of the length of the exercise board 74, 25% to 48% of the length, or 30% to 45% of the length, or any combination of these ranges (e.g. 25 to 45%).

The elastic band 74 can be coupled to the exercise board 52 by any suitable coupling mechanism, such as a first clamp 76 and a second clamp 78. The first clamp 76 is located adjacent to the first side edge 70 and the second clamp is located adjacent to the second side edge 72 (opposite the first side edge 70), although it will be appreciated that the first clamp 76 and/or the second clamp 78 can be positioned at any suitable location on the exercise board 52. Alternative and/or additional coupling mechanisms can be used and are within the scope of this disclosure.

In some embodiments, a portion of the elastic band 74 secured to the first clamp 76 and the second clamp 78 is adjustable. For example, in the illustrated embodiments, the clamps 76 and 78 can be temporarily opened to allow the length of the band 74 located between the first clamp 76 and the second clamp 78 to be increased and/or decreased to accommodate different users. In other embodiments, the elastic band 74 can be adjusted using any suitable adjustment mechanism. The elastic band 74 can comprise any suitable material, such as, rubber-based material, a nylon, vinyl, latex, one or more elastomers and/or her viscoelastic material.

In some embodiments, the elastic band 74 can be formed from multiple elastic bands. For example, in some embodiments, the exercise system 50 includes at least a first elastic band 80 and a second elastic band 82. The first elastic band 80 can have a first resistance and the second elastic band 82 can have a second resistance. The second resistance can be greater than the first resistance, or vice versa. The first elastic band 80 and the second elastic band 82 can each be retained by the clamps 76 and 78 in a similar manner. In other embodiments, the first and second elastic bands 80 and 82 have the same resistance.

In some embodiments, the exercise board 52 includes one or more secondary anchors 84, 86, 88, and 90. The secondary anchors provide anchor points for attaching additional accessories to the exercise board 52. For example, in some embodiments, at least one of the secondary anchor points is a D-ring retention device 92, such as a carabiner. The D-ring retention device 92 is configured to couple via an elastic band 94 to the exercise board 52. The elastic cable 94 can be configured to provide resistance to one or more additional muscle groups of a user. The elastic band 94 can include a first clip 96 at a first end 98 configured to couple the elastic band 94 to the D-ring 100 of the D-ring detention device 92, although it will be appreciated that one or more additional and/or alternative coupling mechanisms can be used.

Figure 10:
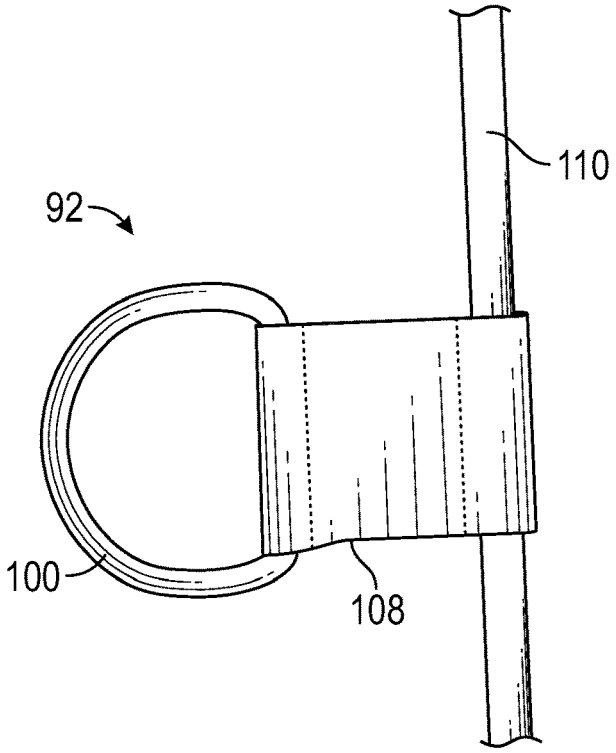
FIG. 10 is a perspective view of an anchor ring retention device in accordance with the principles of the invention.
Figure 11:
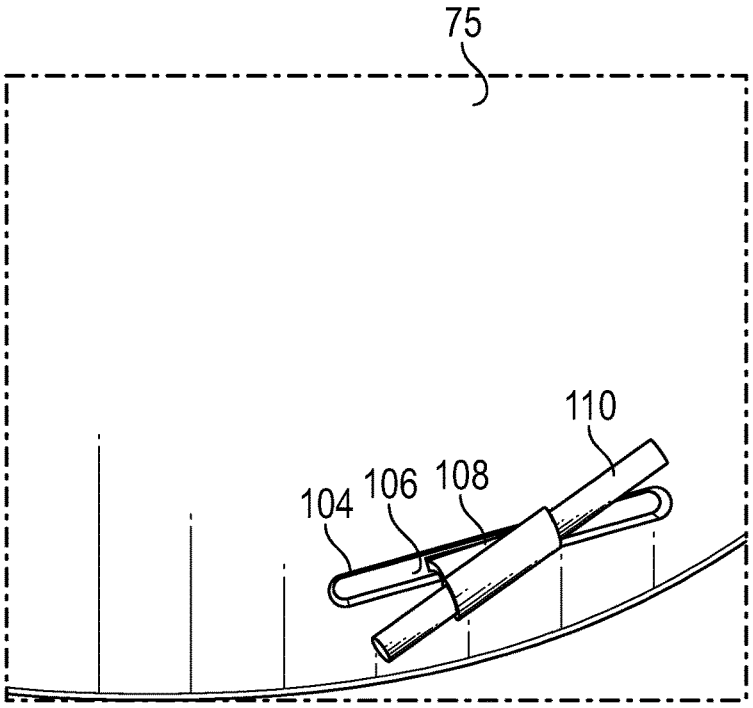
FIG. 11 is a bottom plan view of an anchor point of an exercise board in accordance with the principles of the invention.
Figure 12:
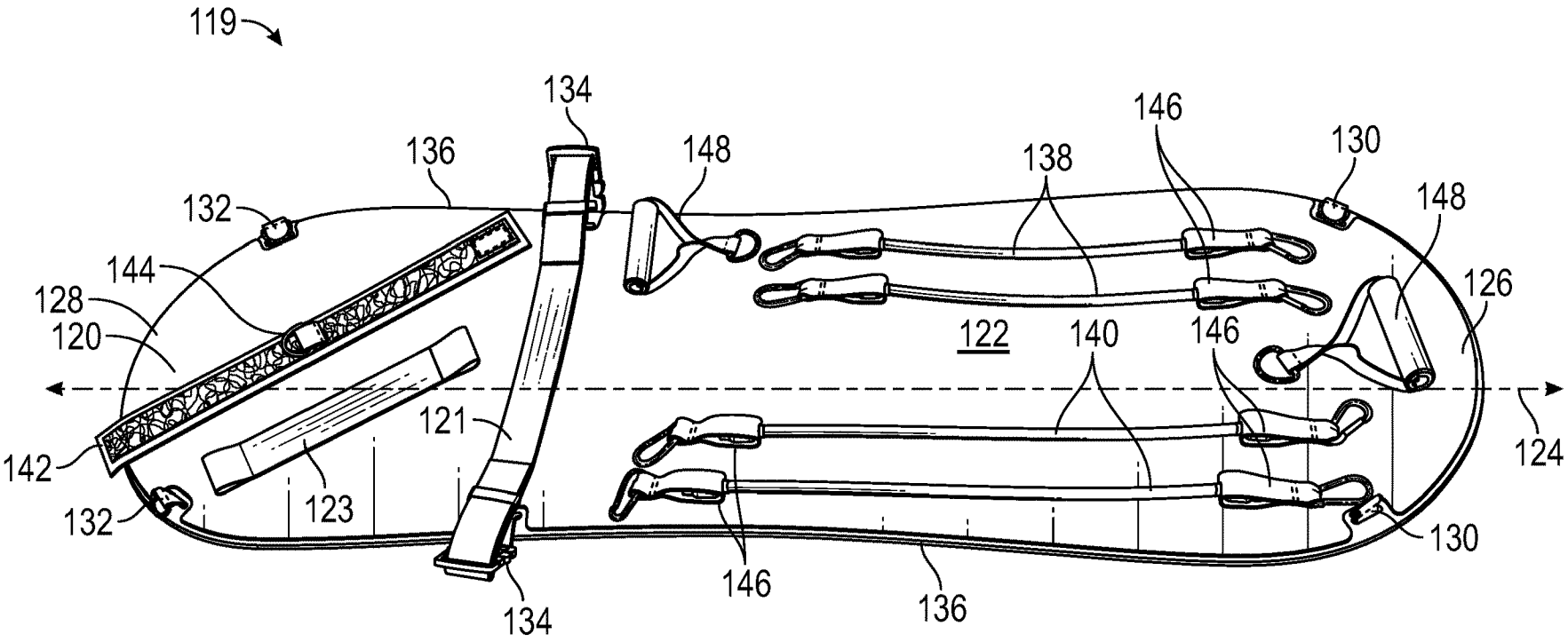
FIG. 12 is a perspective view of an alternative embodiment of an exercise system in accordance with the principles of the invention.

In some embodiments, the one or more secondary anchors 84, 86, 88 and 90 are coupled to the exercise board 52 through one or more channels 104 formed in the exercise board 52. For example, as shown and FIG. 11, in some embodiments the exercise board 52 includes a plurality of channels 104 sized and configured to receive an anchoring mechanism therethrough. In some embodiments, at least a portion of a retention device, such as the D-ring retention device 92 illustrated in FIG. 10, is configured to pass through an opening 106 at the base of the channel 104 to anchor the retention device at a fixed position with respect to the exercise board 52. In some embodiments, the D-ring retention device 92 includes a D-ring 100 coupled to a flexible band 108 and an anchor bar 110. The anchor bar 110 is sized and configured to be inserted through the channel 104 and a first configuration with respect to the channel 104. As shown in FIG. 11, after being inserted through the opening 106, the anchor bar 110 can rest in the channel 104 so the bottom surface 75 of the exercise board 52 can rest flush against the floor, either with or without a skid proof mat 107, which may cover any channels 104 and the bottom of the surface 75.

Figure 6:
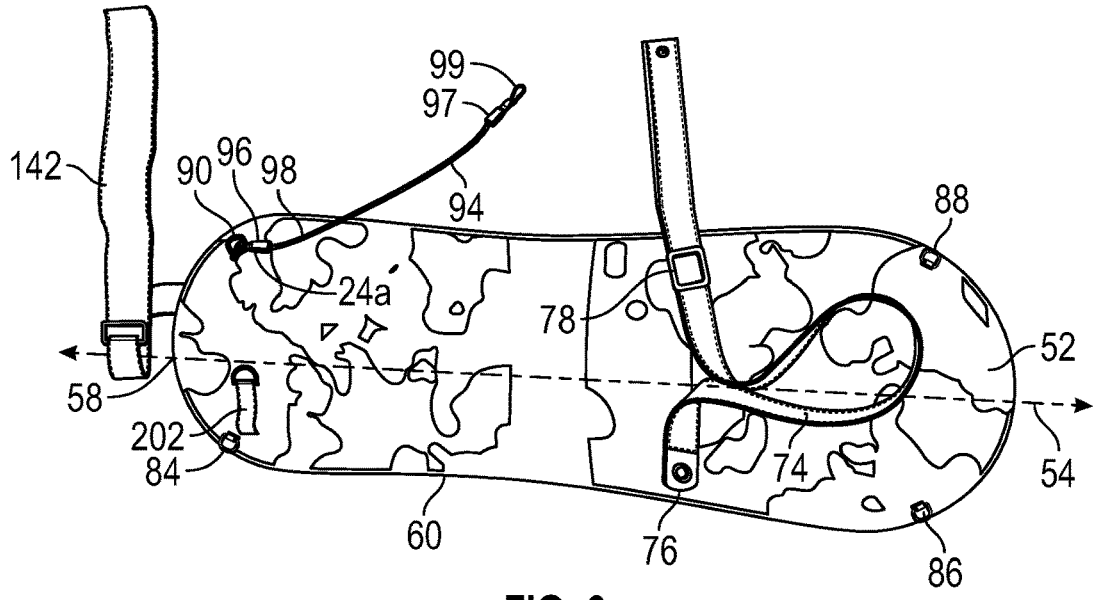
FIG. 6 is a bottom plan view of an exercise board in accordance with the principles of the invention.
Figure 7:
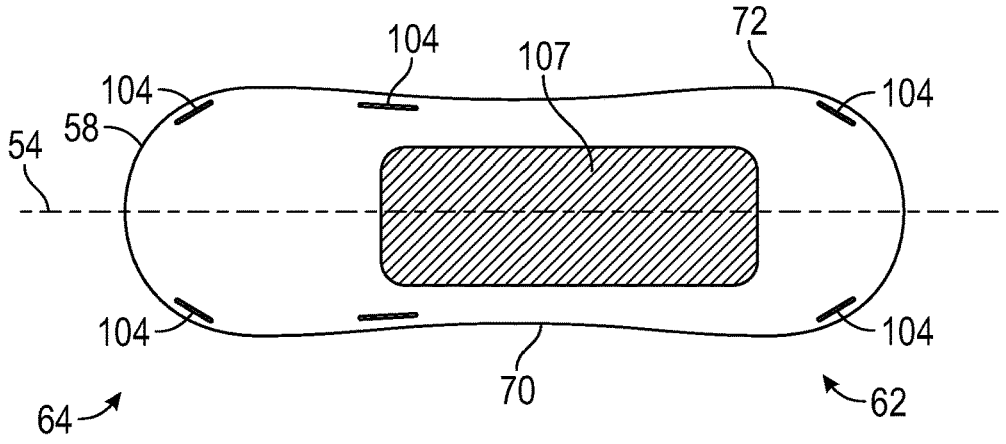
FIG. 7 is a bottom plan view of an exercise board in accordance with principles of the invention.
Figure 8:
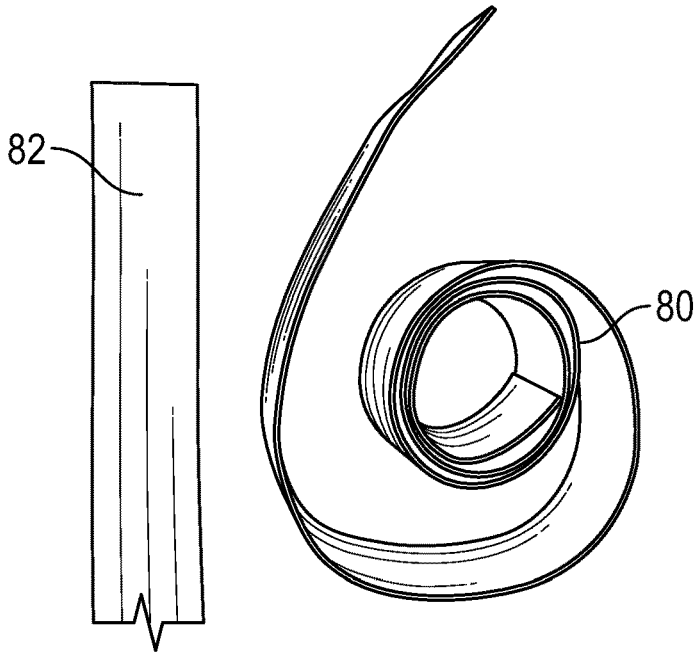
FIG. 8 is a perspective view of two elastic bands in accordance with the principles of the invention.
Figure 9:
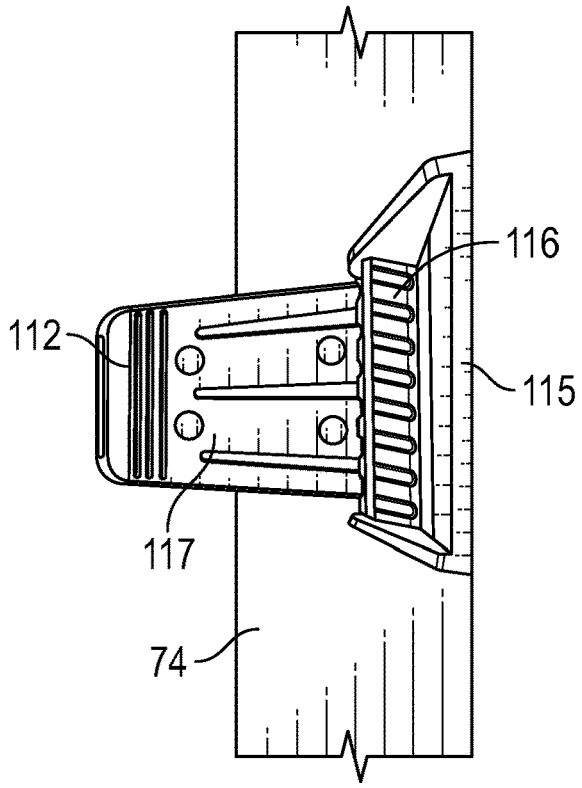
FIG. 9 is a perspective view of a clamp for a belt in accordance with the principles of the invention.

FIG. 9 illustrates one embodiment of a clamp 112 that can be coupled to the exercise board 52 and/or the belt 142. The clamp 112 includes a base 115 defining a channel 116. The channel 116 is sized and configured to receive and elastic band 74, 80 or 82 therethrough. A clamp portion 117 is pivotally coupled to the base 115 and is configured to be rotated from a first open position, as shown in FIG. 9, to a second closed position, as shown in FIG. 6, to retain an elastic band 74, 80 or 82 therein. Although a specific embodiment of a clamp 76 is illustrated, it will be appreciated that any suitable coupling mechanism 16 can be used to couple the elastic band 74 to the exercise board 50 and/or the belt 142.

FIGS. 12-15 show an alternative embodiment of an exercise system 119 based upon the exercise board 120 in accordance with the principles of the invention. The exercise board 120 is substantially planar, having a flat upper surface 122 that may be textured to prevent a user from sliding during use. The exercise board 120 is symmetric along a longitudinal axis 124 that extends from a top end 126 to a bottom end 128. The top end 126 includes two opposing anchor points 130. Similarly, the bottom end 128 includes two opposing anchor points 132. The ends of a primary lap band 121 may be removably affixed to two opposing fasteners 134 located at the opposing side edges 136 of the exercise board 120. The device also includes a first pair of elastic cables 138 having a first level of resistance and a second pair of elastic cables 140 having a second level of resistance. Elastic cables 138 and 140 include cable fasteners 146 at each end that allow either ends of cables 138 and 140 to be removably attached to any of the anchor points 130 and 132. The exercise board 120 optionally includes a second transverse elastic band 123 having a level or resistance the same as or optionally different from that of the primary lap band 121. An adjustable belt 142 has two opposing D rings 144 capable of removable connection to the cable fasteners 146 on the ends of the ancillary elastic cables 138 and 140. Two handgrips 148 are provided and are capable of removable connection to the cable fasteners 146 on the ends of the ancillary elastic cables 138 and 140.

Figure 13:
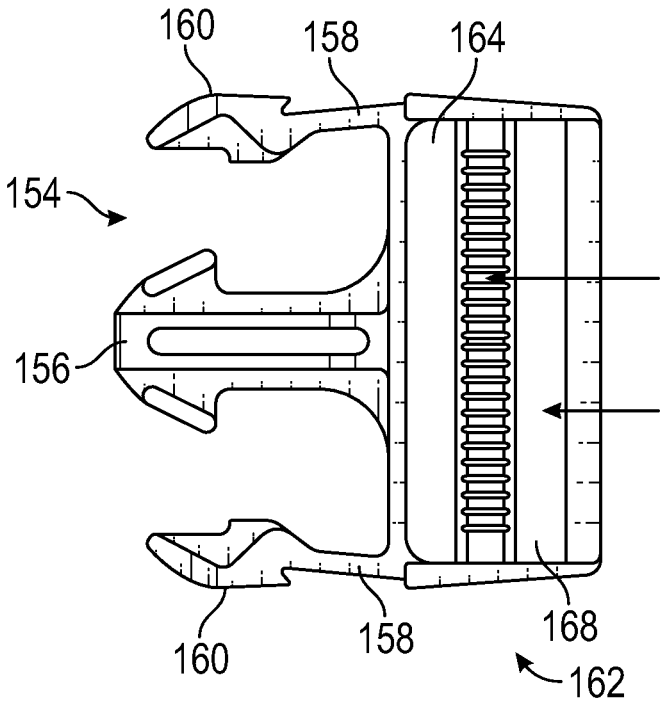
FIG. 13 is a top plan view of a male plug component of a fastener for an exercise board in accordance with the principles of the invention.
Figure 14:
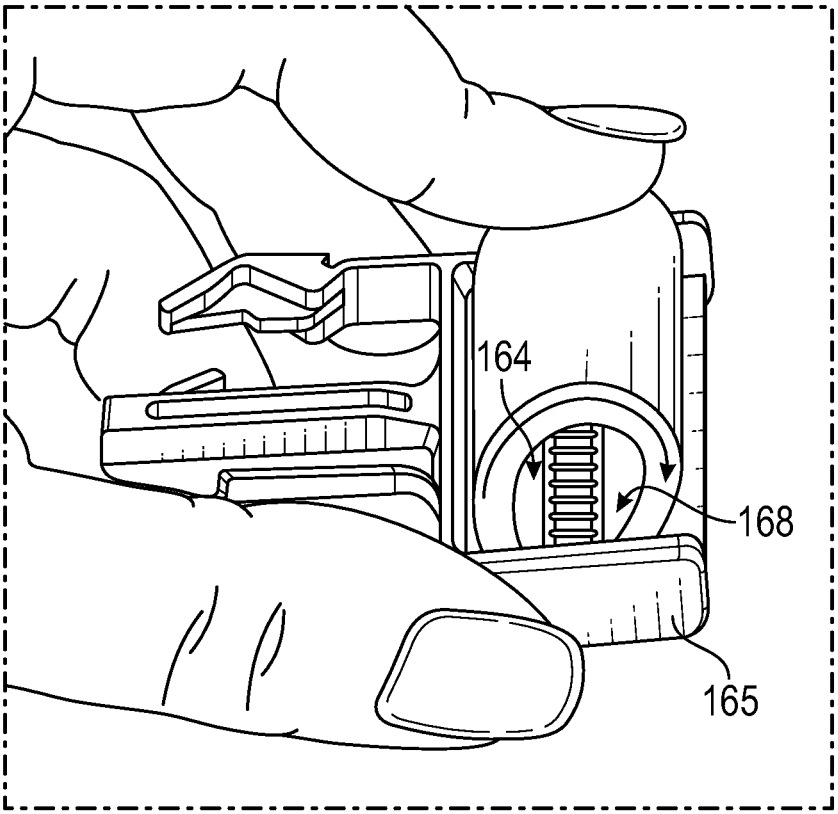
FIG. 14 is a perspective view of a male plug component of a fastener for an exercise board in accordance with the principles of the invention.
Figure 15:
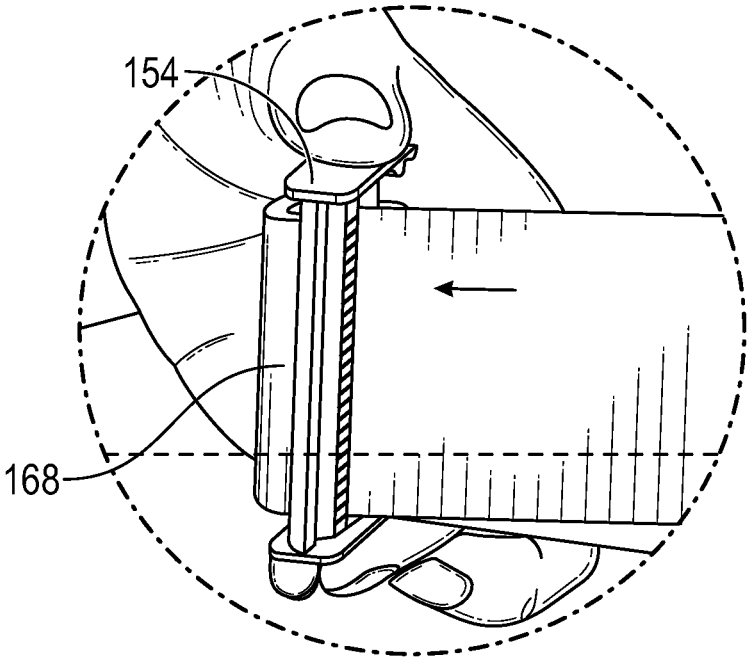
FIG. 15 is another perspective view of a male plug component of a fastener for an exercise board in accordance with the principles of the invention.

In this embodiment, the primary lap band 121 has a flat configuration and the fasteners 134 comprise side release buckles configured to removably and adjustably attach to the end of the lap band 121. FIGS. 13-15 show a male plug component 154 of a fastener 134. The male plug component 154 includes a central guide stem 156 and two deflectable, biased lateral arms 158, each having a lateral detent 160. The band engaging end 162 of the male plug component 154 includes an inner slot 164 and an outer slot 168. To affix to a lap band 121, the male plug component 154 of the buckle is placed in the starting position shown in FIG. 13. The ridges on the inner slot 164 should be facing up. The ridges on the outer slot 168 should be facing down. The lap band 121 is fed through the inner slot 164 from the bottom 165 of the plug component 154. The lap band 121 is then fed down through the outer slot 168. The belt loop is then slid over the loose end toward the buckle to neatly secure in place. When the lap band is secured to the male component 154 of the buckle correctly, the ridges of the outer slot 168 point down toward the lap band 121. If the band slides through the buckle during exercises, the setup was not done properly. It must be adjusted to ensure that the buckle is in the correct starting position.

Figure 16:
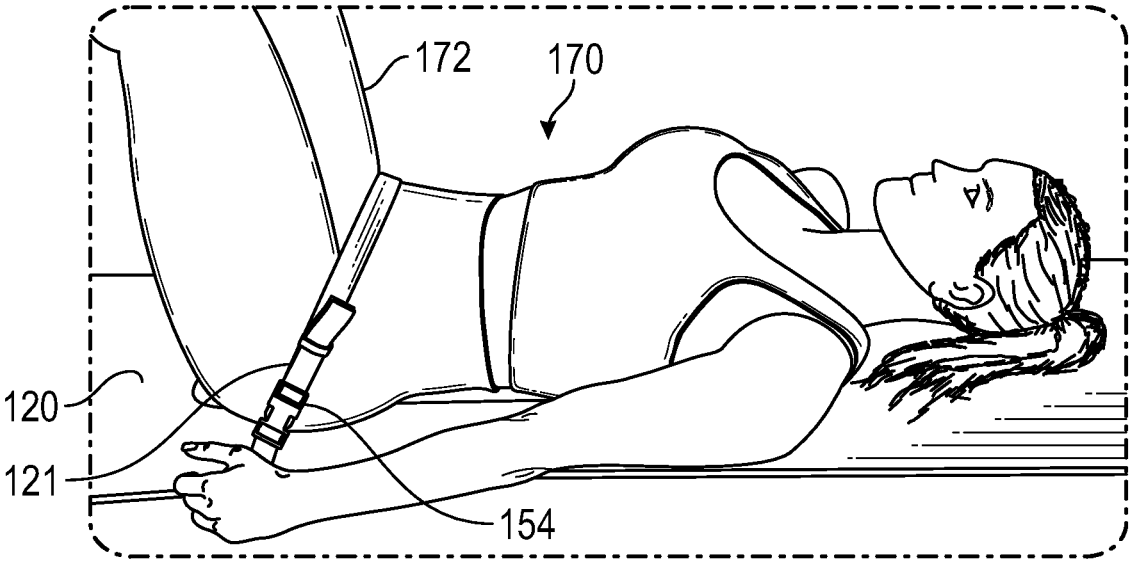
FIG. 16 is a perspective view of a user in a rest position on an exercise board in accordance with the principles of the invention.

FIG. 16 shows the proper placement of the lap band 121 affixed to the exercise board 120 by opposing fasteners 134, including the male plug component 154 in accordance with the principles of the invention. The lap band 121 should be placed below the belly button and above the hips 172. Proper clothing should be worn while using the lap band 121. The male plug components 154 of the fasteners 134 may be used to adjust the length of the lap band 121 to adjust the resistance provided.

As illustrated in FIGS. 17-20, an important feature of the exercise system 119 described herein is the ability to perform a glutes bridge exercise with resistance that is adjustable both in the amount of resistance force and in the direction of that resistance. There are a significant number of gluteal muscles and the adjustability of the exercise system 119 described herein allows the user to target these muscles in a manner previously unavailable to produce the best results for the user in a highly efficient manner.

Figure 17:
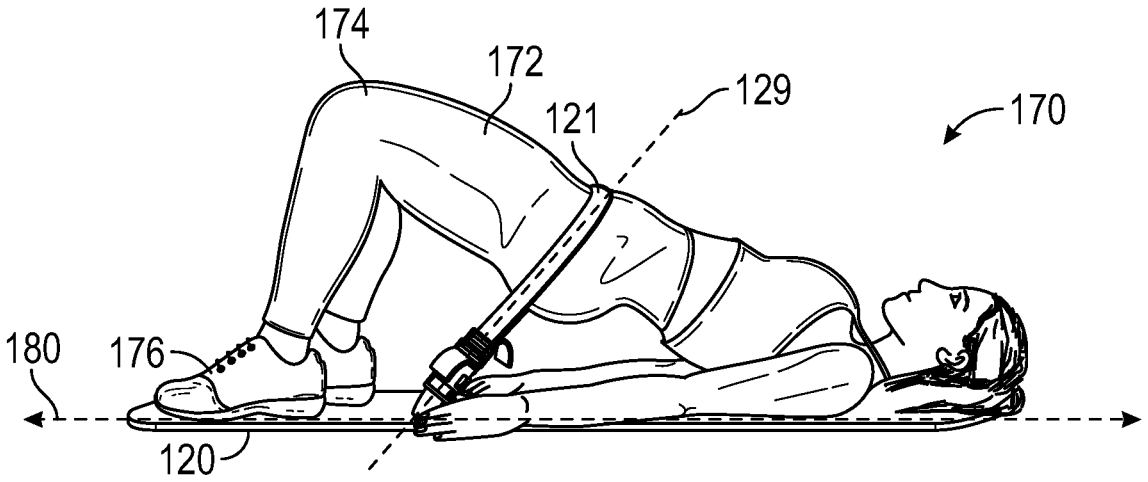
FIG. 17 is a side perspective view of a user in an up position on an exercise board in accordance with principles of the invention.
Figure 18:
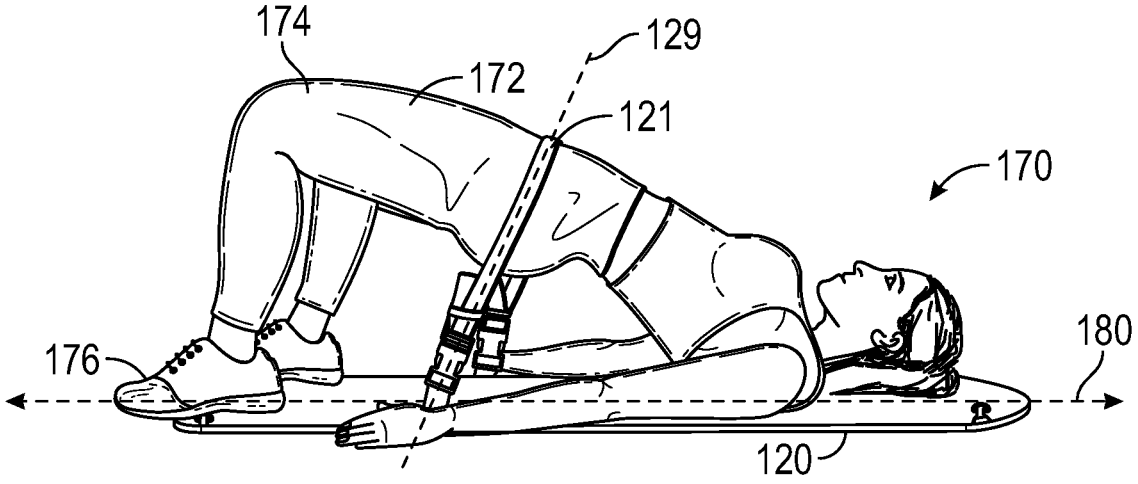
FIG. 18 is a side perspective view of a user in another up position on an exercise board in accordance with the principles of the invention.

FIGS. 17-18 illustrate a user 170 performing a glutes bridge exercise, using the exercise system 119. In operation, a user 170 lies on the exercise board 120 and places the elastic lap band 121 across his or her lap below the belly button and above the hips 172 as shown in FIG. 15. While lying on the back in a supine position with the knees 174 bent, feet 176 flat on the board and having the elastic lap band 121 placed just inferior to the anterior superior iliac spine, the user 170 pushes the pelvis up and straightens the hips 172 to the extended position shown in FIGS. 17 and 18. The acute angle formed by the direction 129 of the band 121 relative to the board 120, which is parallel to the horizontal plane 180, in the extended position can range from about 45° to about 85°. This angle is the direction of the force vector against which the user's muscles are opposing which allows the user to target different gluteal muscles and/or other muscle groups, depending on a desired goal and/or targeted muscle group. In contrast to the exercise system 119, when losing weight machines like a Smith bar or free weights, the force of gravity can only be applied along a vertical line, 90° relative to the horizontal 180. The exercise system 119 is unique in that it allows a user to isolate regions of the glutes and/or other muscle groups in an unprecedented manner. As will be understood, the user can slide toward the top end 126 to decrease the angle at which the band resists the user's movements or toward the bottom end 128 to increase the angle at which the band resists the user's movement. FIG. 17 shows the user 170 positioned such that the angle is about 45°. FIG. 18 shows the user 170 positioned closer to the bottom end 128 of the exercise board 120, thereby increasing the angle formed by the band 121 and the horizontal plane 180 to about 85°.

When a user 170 is positioned as illustrated, the elastic band 121 exerts a force on the user 170 along an arc defined from the position of the elastic band 121 on the user, inferior to the anterior superior iliac spine, to the opposing fasteners 134. In other embodiments, a user 170 is positioned to create a greater angle between the elastic band 121 and horizontal, such as about 75°, isolates an upper portion of a gluteal muscle. Although specific embodiments are illustrated and discussed, it will be appreciated that a user may flex and/or extend along an arc to any suitable angle between about 45° and about 85° with respect to the horizontal 180.

In some embodiments, a length of the exercise board 120 along the longitudinal axis 124 is selected such that the longitudinal length of the exercise board is greater than the longitudinal length of the user 170 when laying supine on the exercise board 120 with bent knees 174. For example, as shown in FIG. 16, when a user 170 is in a resting position, at least a portion of the first end 126 of the exercise board 120 extends beneath the user's 170 head and at least a portion of the second end 128 extends beneath the user's feet 176. This ensures that the exercise board 4 maintains a horizontal position during the exercise. Although specific embodiments are shown herein, it will be appreciated that the exercise board 120 can have any suitable length which may be greater than or equal to the longitudinal length of the user 170 when positioned with bent knees on the exercise board 120.

Figure 19:
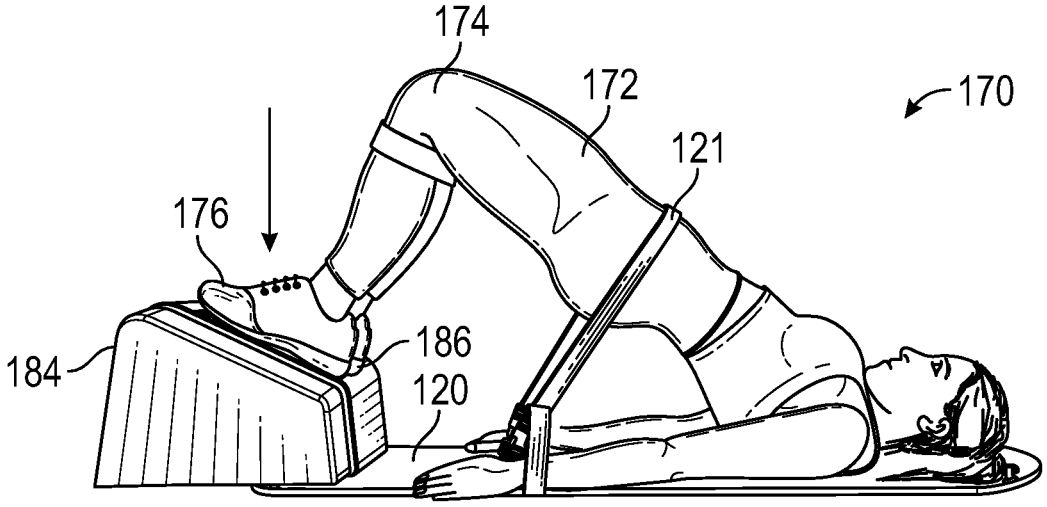
FIG. 19 is a side perspective view of a user in an up position on an exercise board and an exercise block in accordance with the principles of the invention.
Figure 20:
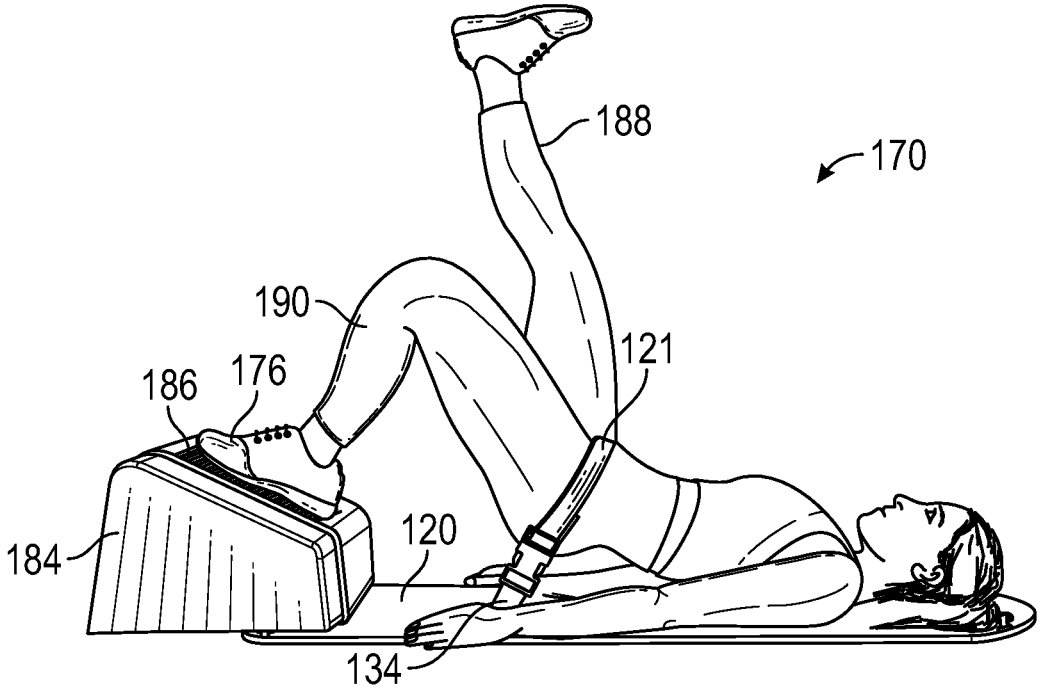
FIG. 20 is a side perspective view of a user on an exercise board and an exercise block in accordance with the principles of the invention.

FIGS. 19 and 20 show a user 170 exercising with the exercise board 120 and an exercise block 184. The exercise block 184 is used to increase intensity and range of motion. The exercise block 184, comprised of foam, his place securely at the bottom of the board 120. The upper surface 186 of the block 184 is configured at an angle such that the feet 176 of the user 170 remain perpendicular to the calves of the user 170 throughout the exercise. It is important to apply downward pressure evenly with your feet straight, pushing through the block toward the floor. When done properly, the block 184 will remain stationary and will not slide. The exerciser 170 has positioned her feet 176 on top 186 of a block 184. By positioning her feet 176 in an elevated location, the exerciser 170 increases the resistive force applied by the lap band 121, thereby intensifying the workout. The block 184 may optionally be removably securable to the mat 120. The block 184 may also optionally have an adjustable height.

FIG. 20 shows another exercise, a single leg thrust, being performed using the exercise board 120 and the phone block 184. The user 170 raises one leg 188 toward the ceiling while the opposite leg 190 maintains a downward foot pressure through the block 180 to the floor. A user 170 may alternate this exercise between legs 188 and 190 and may incorporated this exercise into a set of glute bridge exercises.

In some embodiments, the exercise system 119 includes a belt 142 sized and configured to be worn by a user. The belt 142 includes one or more fasteners 200 configured to couple the belt 142 to the elastic lap band 121 or 123. The belt 142 can be coupled to elastic bands 80 and 82 to provide elastic resistance to a user performing one or more exercises, such as, for example, squats, lunges, etc. Although embodiments are illustrated having fasteners 200 comprising buckles, it will be appreciated that the belt 142 can be coupled to the elastic band 80 and 82 using any suitable mechanism. One side of the lap band 80 is disconnected from one of the opposing fasteners 134 and connected to a fastener 200 on the belt 142 which is placed around the waist. While facing toward the bottom of the board 120, the user 170 kneels down and then stands back up, performing a classic lunch.

Figure 21:
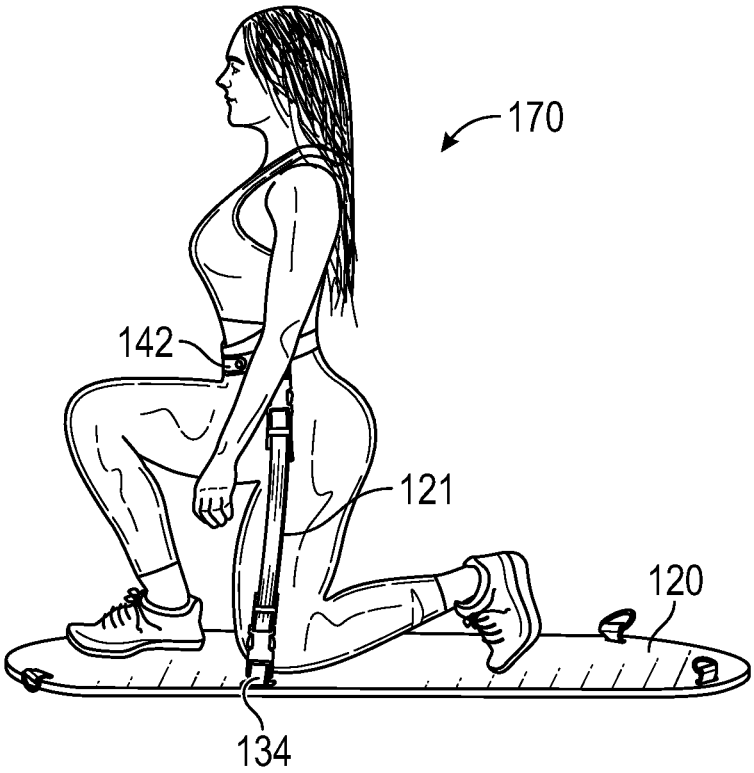
FIG. 21 is a side perspective view of a user performing lunges on an exercise board in accordance with the principles of the invention.
Figure 22:
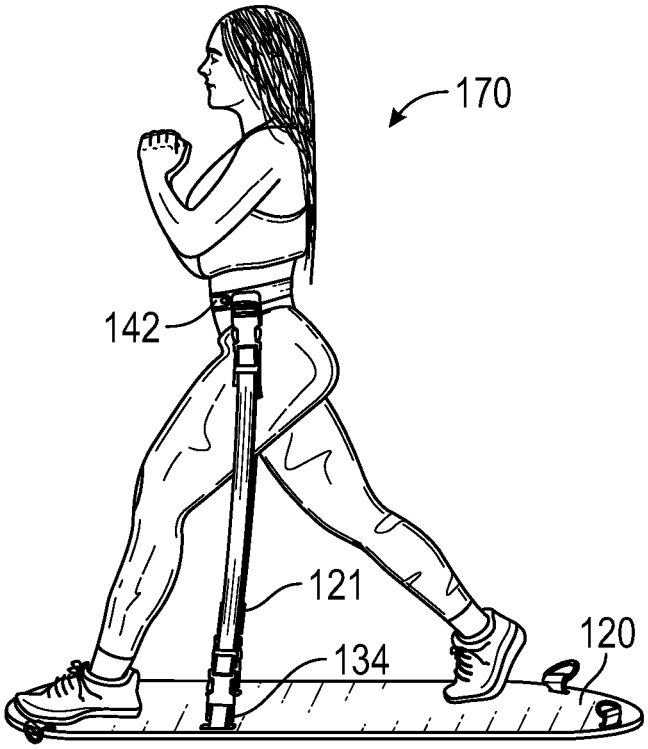
FIG. 22 is another side perspective view of a user performing lunges on an exercise board in accordance with the principles of the invention.

FIGS. 21 and 22 illustrate a user 170 wearing a belt 142 coupled to a first elastic band 121 which is also affixed the exercise board 120 at one of the opposing fasteners 134. Optionally, the second elastic band 123 may be affixed to the opposing fastener 134 and two and opposite side of the belt 142 from the first elastic band 121. The user 170 may then perform lunges, or optionally squats or other exercises. The bands 121 and 123 may be adjusted to change the resistance a user 170 acts against. When using the belt 142 with one or more elastic bands 121 and 123 to do lunges, squats, and/or other exercises, the exercise system 119 eliminates any loading forces of gravity that could have been placed on the spinal column during traditional leg and/or glutes strengthening exercises that rely on conventional weights. The bands 121 and 123, and belt 142 system avoids loading issues and protects the tissue, discs, and nerves of the spinal column.

Figure 23:
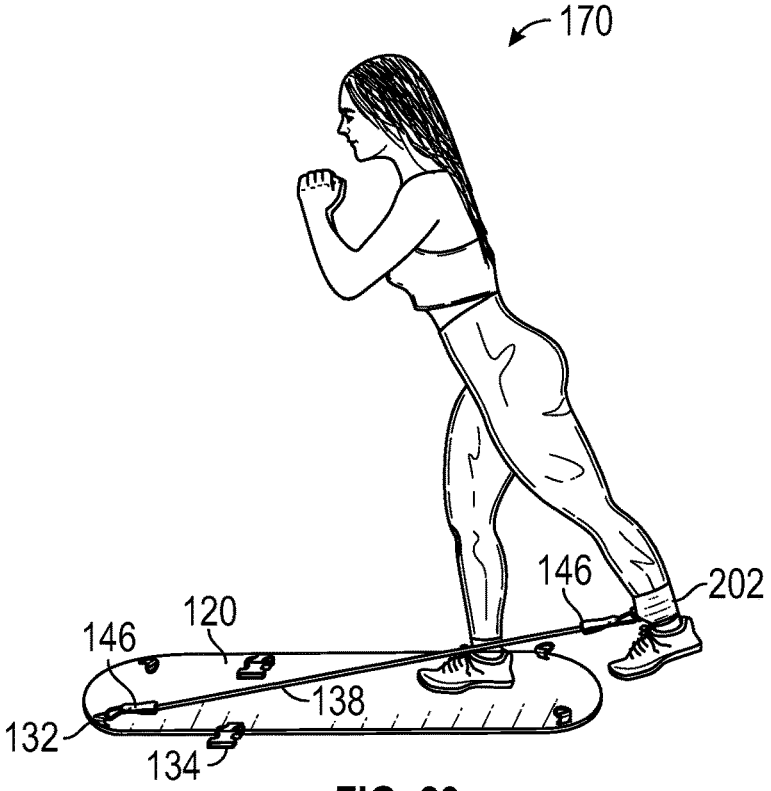
FIG. 23 is a side perspective view of a user performing a different exercise on an exercise board in accordance with the principles of the invention.

FIG. 23 illustrates a user 170 performing a third exercise using a first ancillary elastic cable 138 coupled to a bottom anchor point 132 of the exercise system 119, in accordance with some embodiments. The cable 138 is coupled to the exercise board 120 at a bottom end 128 by a cable fastener 146 at one ends, and is attached to an ankle cuff 202 by means of the cable fastener 146 at its other end. While maintaining balance, the user 170 raises one leg. As a user 170 rotates the foot/ankle away from the bottom anchor point 132, the cable 138 provides elastic resistance to the movement to strengthen the abductor or abductor muscles of the hip or the gluteal muscles.

Figure 24:
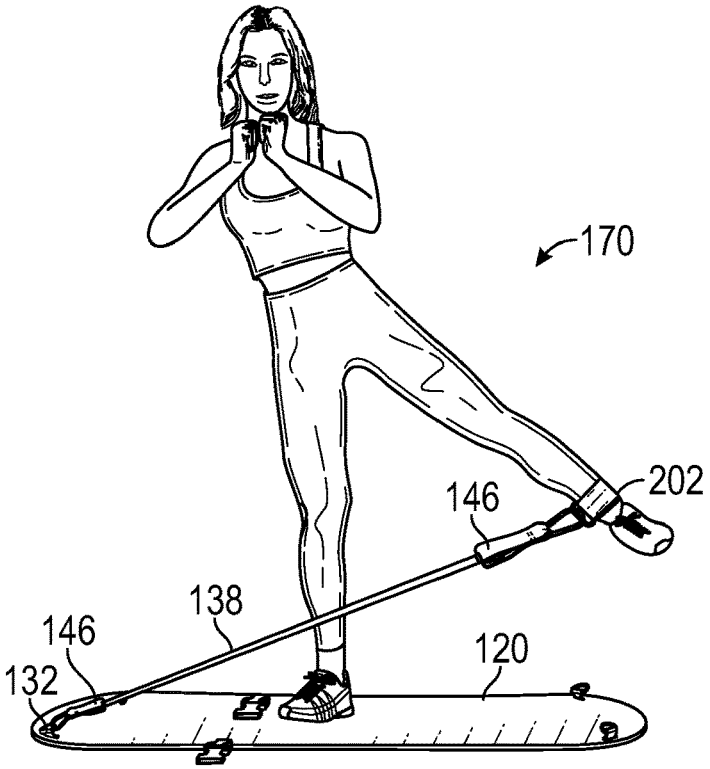
FIG. 24 is another side perspective view of a user performing a different exercise on an exercise board in accordance with the principles of the invention.

FIG. 24 shows the exercise system 119 in the same configuration with the user 170 having rotated 90°. This allows the user 170 to exercise different muscles in the legs. Similarly, the cables 138 and 140 utilized with the system 119 can be used for upper body exercises, such as curls, rose, military press, and others. The exercise system 119 shown here in includes two pairs of ancillary cables 138 and 140. Those skilled in the art will appreciate that several additional cables having different resistances may optionally be included and used in accordance with the principles of the invention.

Figure 25:
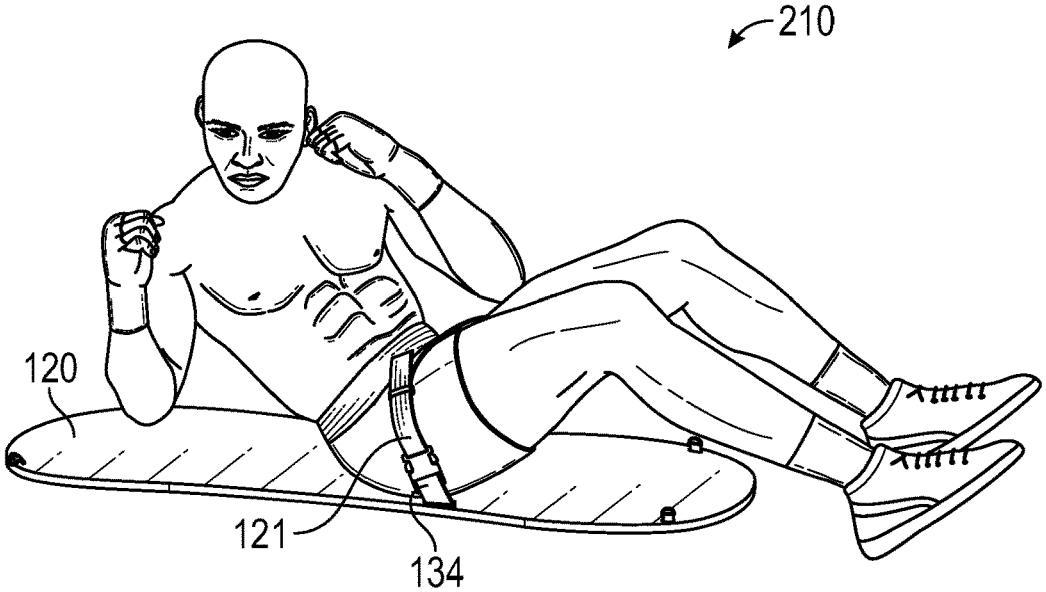
FIG. 25 is a side perspective view of another user performing a different exercise on an exercise board in accordance with the principles of the invention.
Figure 26:
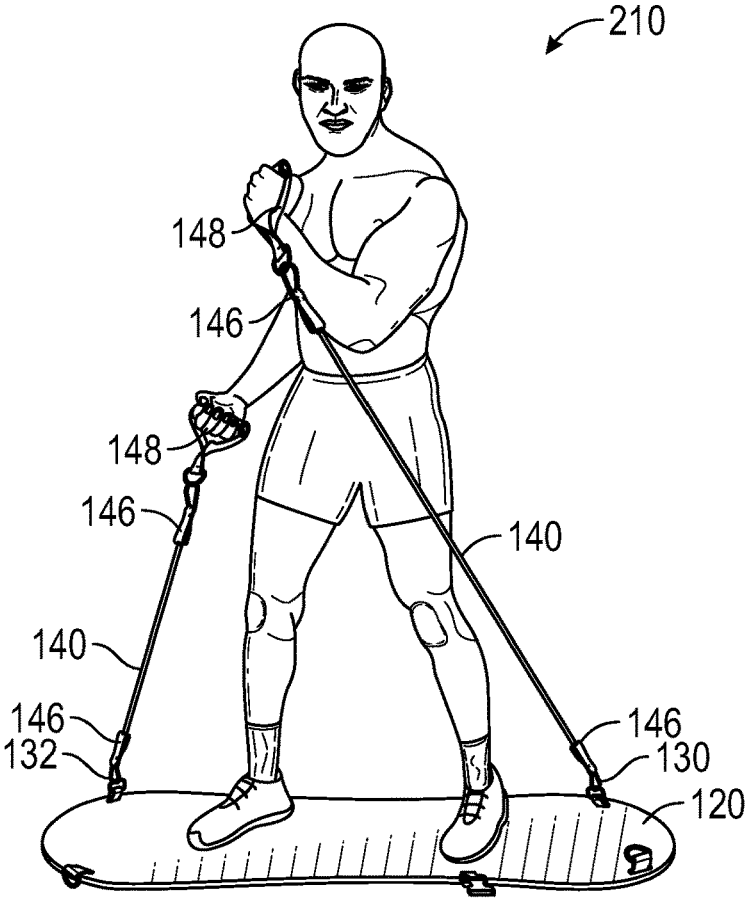
FIG. 26 is another perspective view of another exerciser performing a different exercise on an exercise board in accordance with principles of the invention.

FIG. 25 shows another user 210 performing crunches in accordance with the principles of the invention. The user 210 straps the lap band 121 across his hips and adjusts the fasteners 134 to pin his hips to the board 120. This allows the user 210 to perform crunches without assistance. FIG. 26 shows a user 210 using the exercise system 119 to perform bicep curl exercises. A pair of ancillary elastic cables 138, 140 or another optional pair altogether may be used. In this embodiment, the user 210 affixes one end of each of the second pair of elastic cables 140 to one of the anchor points 130 and 132 of the board 120. The other ends of the cables 140 are attached to the handgrips 148, which are held by the user 210 standing upright. Curls may be performed in a wide range of motion. While maintaining a strong core and both feet placed firmly on the board, the user 210 curls his arm to his chest. For increased resistance, the user 210 can attach two resistance cables to one handle.

Figure 27:
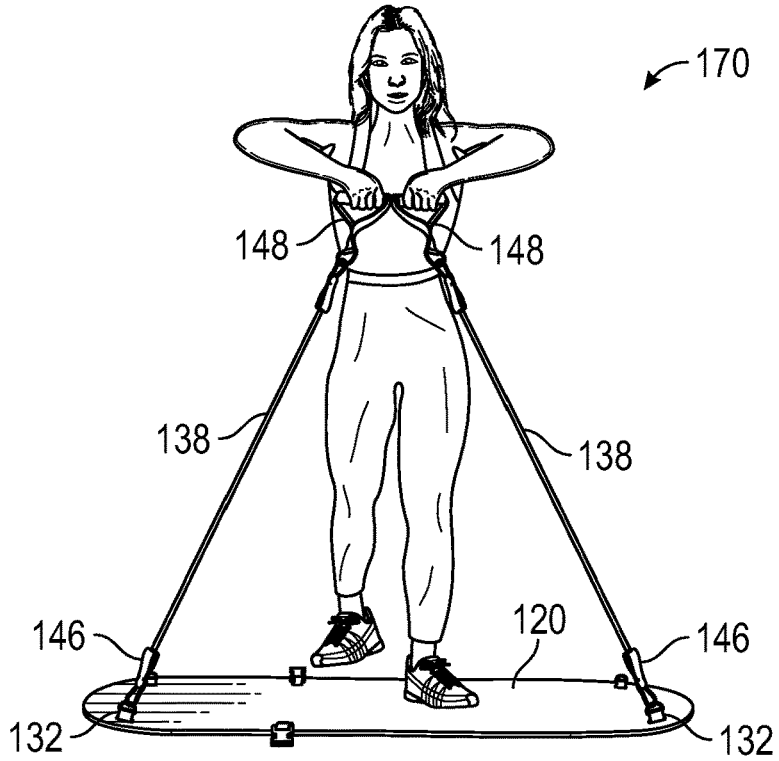
FIG. 27 is another perspective view of an exerciser performing a different exercise on an exercise board in accordance with the principles of the invention.

FIG. 27 shows the user 170 with the exercise system 119 configured for performing upright row exercises in accordance with the principles of the invention. Two of the ancillary cables 138 are affixed to the board 120 in the same manner as that shown in FIG. 26. User 170 has a staggered stance, placing 1 foot firmly in the center of the board and the opposite foot on the floor. The user 170 holds her hands close together and raises them evenly with both arms while keeping her elbows elevated.

Figure 28:
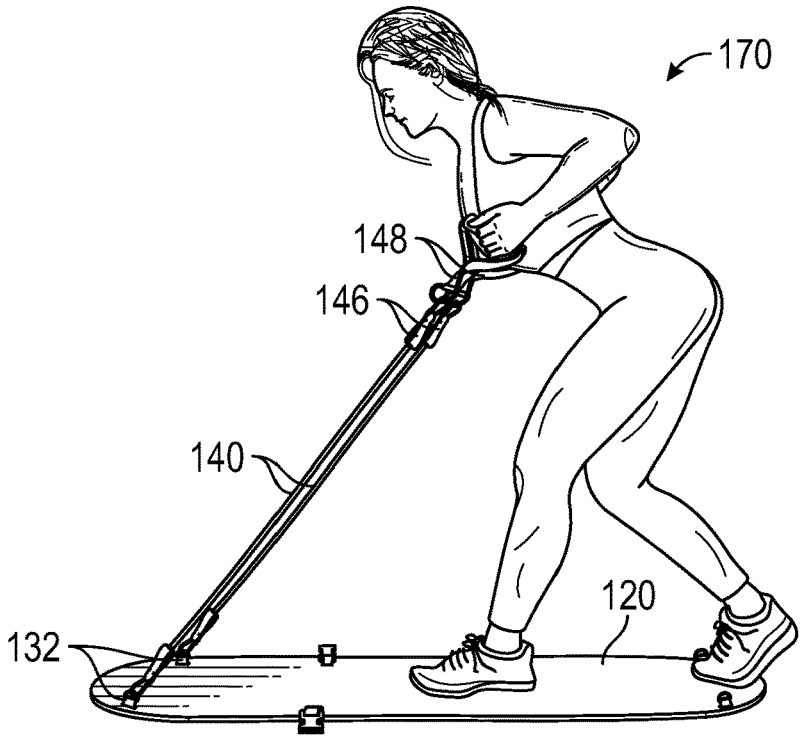
FIG. 28 is another perspective view of an exerciser performing a different exercise on an exercise board in accordance with the principles of the invention.

FIG. 28 shows the user 170 performing a bench overrode exercise using the exercise system 119 in accordance with the principles of the invention. The user 170 forms a staggered stance by placing one foot firmly in the center of the board 120. While maintaining a strong core and slightly arched spine, the user 170 slightly arches her spine and draws her arms back allowing shoulder blades to come together.

Figure 29:
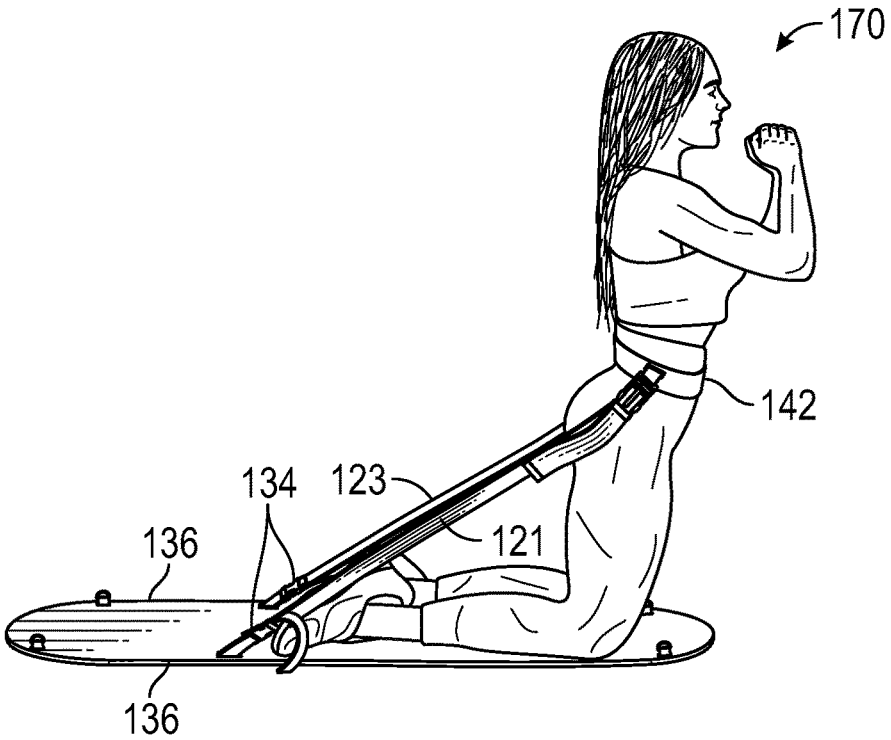
FIG. 29 is another perspective view of an exerciser performing a different exercise on an exercise board in accordance with the principles of the invention.

FIG. 29 shows the user 170 performing kneeling hip thrusts using the exercise system 119 in accordance with the principles of the invention. The exercise system 119 is configured in a manner similar to that shown in—FIGS. 21 and 22. Two elastic bands 121 and 123 are affixed to the opposing fasteners 134 on each opposing side edges 136 of the exercise board 120. Elastic bands 121 and 123 are also affixed to opposite sides of the belt 142. The user 170 starts by facing the top of the board and kneels down on both knees. The elastic bands 121 and 123 are adjusted, removing excess slack evenly from both sides. While maintaining balance, the user 170 thrusts her hips forward and holds for 2 to 3 seconds while squeezing her glutes.

Figure 30:
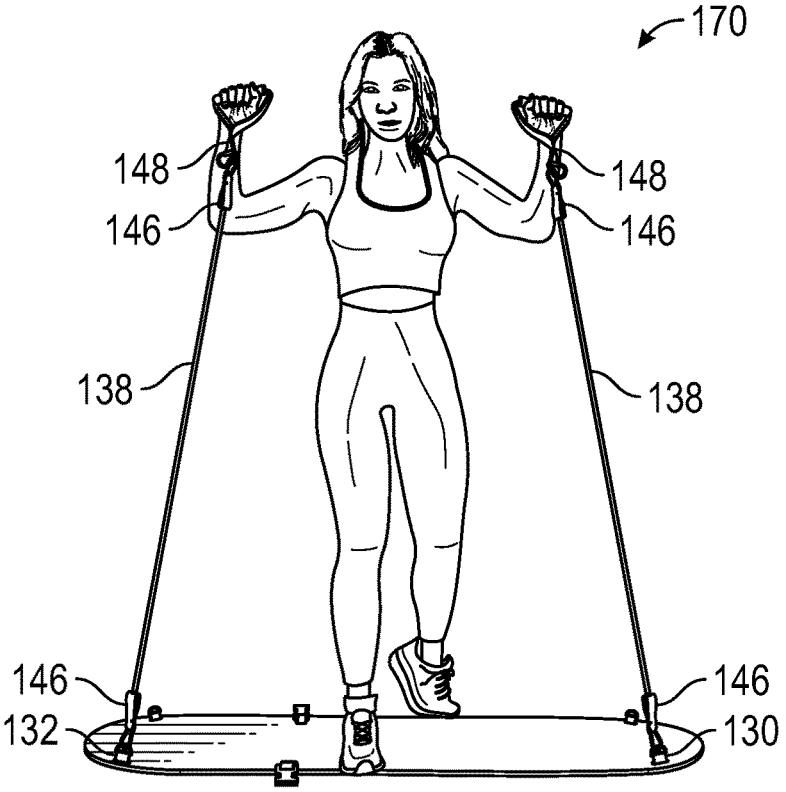
FIG. 30 is another perspective view of an exerciser performing a different exercise on an exercise board in accordance with the principles of the invention.

FIG. 30 shows a user 170 using the exercise system 119 to perform shoulder press exercises in accordance with the principles of the invention. The exercise system 119 is configured in a manner similar to that shown in—FIGS. 26 and 27. The user 170 staggers or stance by placing one foot firmly in the center of the board and the opposite foot on the floor. The user 170 presses her arms over her head to engage the shoulder muscles.

Figure 31:
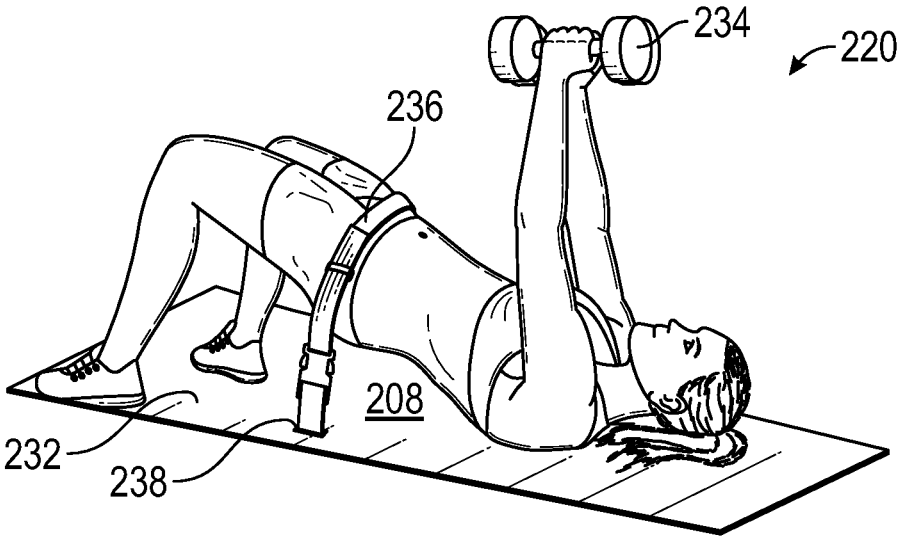
FIG. 31 is another perspective view of another exerciser performing a different exercise on an alternative exercise board in accordance with principles of the invention.

FIG. 31 shows another exerciser 220 performing a modified glute bridge exercise commonly referred to as a chest fly glute bridge while lying on an exercise mat 232 in accordance with the principles of the invention. In this exercise, an exerciser 220 holds a dumbbell 234 in each hand, which are extended laterally from the body when at rest. As the exerciser 220 raises her pelvis, she simultaneously performs a chest fly exercise with her arms. An elastic band 236 extends between two opposing anchors 238 on the upper surface 240 of the exercise mat 232 and over the user 220. As explained above, the exerciser 200 may reposition herself at a different location on the exercise mat 232 in order to adjust the direction of the force applied by the band 236.

Figure 32:
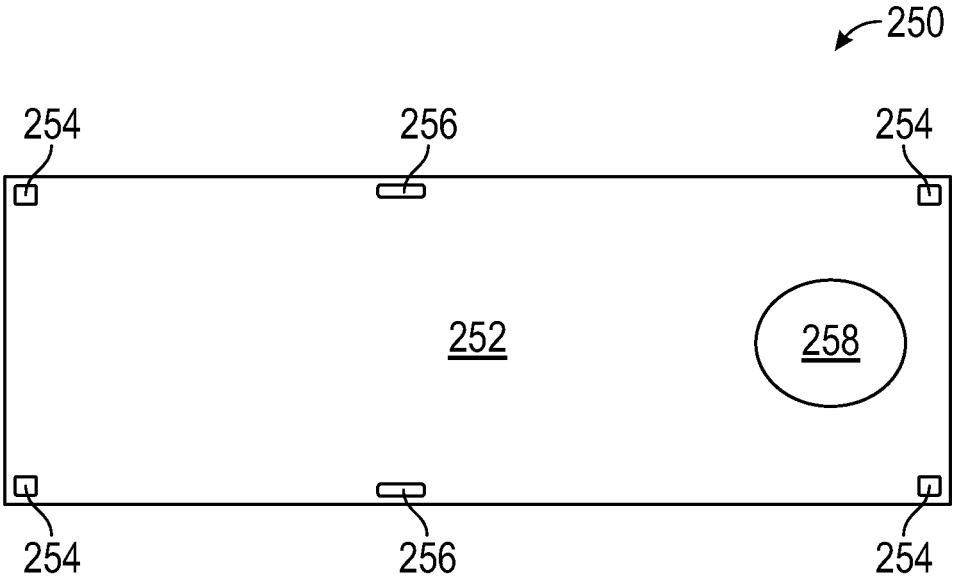
FIG. 32 is a top plan view of an alternative embodiment of an exercise board in accordance with the principles of the invention.

FIG. 32 shows an alternative embodiment of an exercise board 250 in accordance with principles of the invention. The exercise board 250 is substantially planar and has a rectangular body 252. Four anchor points 254 are positioned in each of the corners of the board 250. Opposing fasteners 256 provide attachment to a lap band, not shown. The exercise board 250 includes a head rest pad 258 which is optionally adjustable.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. An exercise system, comprising:

an exercise board extending longitudinally from a top end to a bottom end, the exercise board having a horizontal plane that is coplanar with an upper surface of the exercise board;

two opposing side release buckles located on each of two opposing sides of the exercise board; and a flat, elastic band having a rectangular cross-section, the elastic band having two opposing ends each adapted to be adjustably coupled to the opposing side release buckles of the exercise board, the elastic band having a vector that corresponds to a direction of the elastic band relative to the exercise board; and an acute angle formed by the horizontal plane and the vector, wherein each side release buckle is configured to removably and adjustably attach to the elastic band, each side release buckle comprising:

a male plug component configured to receive one of the two opposing ends of the elastic band, and a female plug component configured to couple to the exercise board, wherein each side release buckle is positioned proximate to a perimeter of the exercise board such that the elastic band is configured to contact a user at a position just inferior to the anterior superior iliac spine when the user lies on the exercise board, and wherein the elastic band is configured to pivot with respect to the exercise board such that the acute angle is adjustable between a rest position and an up position.

2. The exercise system of claim 1, comprising at least one cable retention device coupled to the exercise board, wherein the cable retention device is configured to couple an elastic cable to the exercise board.

3. The exercise system of claim 1, wherein the exercise board further comprises:

a planar, rigid body having a length extending from the top end to the bottom end and an upper surface and a bottom surface; and a first opening extending in the body from the upper surface to the bottom surface and, the first opening extending along a portion of the length of the body.

4. The exercise system of claim 3 wherein the body has a foot region, a head region and a shoulder region and further comprises a padded headrest on the head region.

5. The exercise system of claim 4 wherein the foot region is configured and sized to accommodate two feet of a person exercising on the exercise mat and having a textured surface; and, a shoulder region configured and sized to accommodate shoulders of the person exercising on the exercise mat and having a textured surface.

6. The exercise system of claim 3, wherein the first opening is located along a first side of the body, and further comprising:

a second opening extending along a second side of the body coextensive with and opposing to the first opening, wherein each of the two opposing side release buckles are coupled to the first opening and the second opening, respectively, and wherein the elastic band is attached to a first of the side release buckles at a first end and a second of the side release buckles at a second end.

7. The exercise system of claim 1, wherein each side release buckle is mounted to the exercise board proximate opposite side edges of the exercise board at a position 20% to 49% of a length of the exercise board.

8. The exercise system of claim 1, further comprising a pair of fasteners coupled proximate the perimeter of the exercise board, said pair of fasteners adapted for coupling to a second elastic band for performing a leg exercise.

9. The exercise system of claim 1, further comprising a belt adapted to removably couple to at least two elastic bands wherein an opposite end of each of the at least two elastic bands is adapted to removably couple to the two opposing side release buckles for performing a leg exercise without inducing additional stress on the user's back.

10. The exercise system of claim 1, wherein the acute angle ranges from about 45° to about 85°.

11. The exercise system of claim 1, wherein the acute angle decreases when the user moves toward the top end and increases when the user moves toward the bottom end.

12. The exercise system of claim 1, wherein each of the two opposing side release buckles is coupled to the exercise board via an opening in the exercise board.

13. The exercise system of claim 1, wherein the exercise board has a planar, flat upper surface.

14. The exercise system of claim 1, wherein the elastic band is formed of multiple elastic bands.

15. A method for performing a gluteus bridge exercise comprising:

providing an exercise mat having a planar, rigid body having a foot region, a shoulder region, a length and two sides, the two sides having opposing coextensive openings extending through the body and along a portion of the length of the body, wherein each of the openings has a slidingly engaged fastener, wherein the two fasteners are directly attached to an elastic resistive band, wherein the two fasteners serve as angular and resistance adjustable anchor points for the elastic resistive band extending between them;

positioning an exerciser in a supine position on top of the exercise mat with the exerciser's shoulders positioned within the shoulder region and the exerciser's feet positioned within the foot region and the elastic resistive band extending over the exerciser's pelvic region; and translating the exerciser's body between a rest position and an up position, wherein, in the rest position, the exerciser's gluteus muscles rest on the body of the exercise mat between the shoulder region and the foot region and the exerciser's thighs and torso form an obtuse angle and the elastic resistive band is positioned inferior to the anterior superior iliac spine and exerts a force on the exerciser, wherein, in the up position, the exerciser's gluteus muscles are positioned above the exercise mat and the exerciser's thighs and torso are parallel, wherein an angle between the resistive band and the exercise mat is adjustable between the rest position and the up position, and wherein the resistance exerted on the exerciser is adjustable in an amount of resistance force and in the direction of the resistance.

16. The method of claim 15 wherein the region of the exerciser's gluteus muscles are targeted by aligning the elastic resistive band along a plane that intersects the targeted region of the gluteus muscles.

* * * * *